US008574488B2

(12) United States Patent
MacRae

(10) Patent No.: US 8,574,488 B2
(45) **Date of Patent: *Nov. 5, 2013**

(54) FURNACE REFRACTORY BRICK HEARTH TAP HOLE

(76) Inventor: Allan MacRae, Hayward, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/552,645

(22) Filed: Jul. 19, 2012

(65) Prior Publication Data

US 2013/0099432 A1 Apr. 25, 2013

Related U.S. Application Data

(62) Division of application No. 13/278,014, filed on Oct. 20, 2011.

(51) Int. Cl.
*F27D 3/15* (2006.01)

(52) U.S. Cl.
USPC ..... 266/285; 266/286

(58) Field of Classification Search
USPC ..... 266/280, 285, 286
See application file for complete search history.

(56) References Cited

U.S. PATENT DOCUMENTS

| | | | | |
|---|---|---|---|---|
| 4,773,630 | A * | 9/1988 | Carminati et al. | 266/285 |
| 8,325,779 | B2 * | 12/2012 | MacRae | 373/72 |
| 2013/0099430 | A1 * | 4/2013 | MacRae | 266/44 |

* cited by examiner

*Primary Examiner* — Scott Kastler
(74) *Attorney, Agent, or Firm* — Richard B. Main; Main Law Firm

(57) ABSTRACT

A method for accommodating increasing outward pressures in the tap holes of a hearth furnace includes configuring a tap hole lining and disposing it inside a hollow cylindrical conduit such that the tap hole lining can slide in response to outward pressures and growth in the hearth brick. The tap hole lining is retained inside the hollow cylindrical conduit with a retaining ring and spring assemblies.

7 Claims, 11 Drawing Sheets

FURNACE REFRACTORY BRICK HEARTH TAP HOLE

RELATED APPLICATION

This Application is a divisional application of U.S. patent application Ser. No. 13/278,014, filed Oct. 20, 2011, and titled, ELASTICALLY INTERCONNECTED COOLER COMPRESSED HEARTH AND WALLS, a first action of such is expected by September 2013.

BACKGROUND

1. Field of the Invention

The present invention relates to round-bottom pyrometallergical furnaces for the smelting, converting, or melting of concentrates, mattes, or metals; and more particularly to the construction of tap holes in the brick hearth and lower walls in a furnace refractory where tap hole brick linings can slide inside a conduit, shell, sleeve, water-cooled block or similar structure to accommodate growth in the hearth brick.

2. Description of the Prior Art

One type of smelting furnace for winning copper from ore is built with vertical, cylindrical, steel containment shells with layers of refractory bricks inside the walls and a downwardly dished bottom. A hearth brick sub-layer on the bottom is covered with a brick hearth working layer. The refractory brick layers inside the steel containment shells can withstand the very high operating temperatures usual to the smelting of copper concentrate, and the outer shell provides the necessary containment and support.

Hearth bricks swell up in size over their operational lives as the bricks slowly absorb molecules of metal. Many expensive and complex ways have been devised over the years to keep the refractory bricks tightly pressed together as they swell so that liquid metal, matte, or slag cannot leak through the gaps. For example, so-called "flexible shells" bind adjoining overlapping or segmented plates together using a combination of springs, tie rods, or levers and rods. The loose plate construction can allow for quite a lot of expansion and contraction. However, the cost of these kinds of containment shells is prohibitive.

Rigid hearth containment shells are much less expensive since they are constructed as a single rigid piece that does not require plate binding mechanisms. But conventional ways of keeping the hearth bricks together under the right pressures for these rigid shells accommodates only very limited growth in the hearth brick before shutdown and replacement with new brick is required.

Conventional systems are normally designed to accommodate the thermal expansion of the bricks, but do not maintain the pressure when the bricks cool down and shrink. This allows gaps to form which can invite molten materials to penetrate the brick joints. When the furnace finally reheats, the hearth is incrementally increased in diameter by the new material frozen in the joints. It therefore follows that extending the service life of the hearth bricks translates directly into substantial savings in the maintenance costs because shutdowns are fewer and less frequent, and not as many brick replacements are needed over the life of the furnace.

A basic problem with the design of circular furnaces has been the hearths tend to expand more than do the walls. This is especially pronounced if the walls are water cooled. What is needed are designs that can accommodate both hearth expansion and lesser expansions in the lower wall brick and any refractory.

SUMMARY OF THE INVENTION

Briefly, a method embodiment of the present invention accommodates increasing outward pressures in the tap holes of a hearth furnace by configuring a tap hole lining and disposing it inside a hollow cylindrical conduit so the tap hole lining can slide in response to outward pressures and growth in the hearth brick. The tap hole lining is retained inside the hollow cylindrical conduit with a retaining ring and spring assemblies.

A principal use for such method embodiment is found in an elastically interconnected cooler compressed hearth having a concave dished bottom lined with a sub-layer and a working layer of hearth bricks. Cylindrical walls rise up from the rim of the concave dished bottom. These are constructed with one or more tiers of coolers shaped in arc segments that are joined together into complete rings. The outer perimeter of the hearth brick within the ringed tiers is inwardly compressed toward the center to disallow any leaks from forming between the separate bricks. Flanges are provided on the outside peripheries of each cooler so the coolers themselves can be assembled into rings and elastically interconnected by fasteners and springs. Each spring can be individually adjusted to obtain optimal working pressures on the whole of the hearth bricks.

These and other objects and advantages of the present invention will no doubt become obvious to those of ordinary skill in the art after having read the following detailed description of the preferred embodiments which are illustrated in the various drawing figures.

IN THE DRAWINGS

Figure 5A:
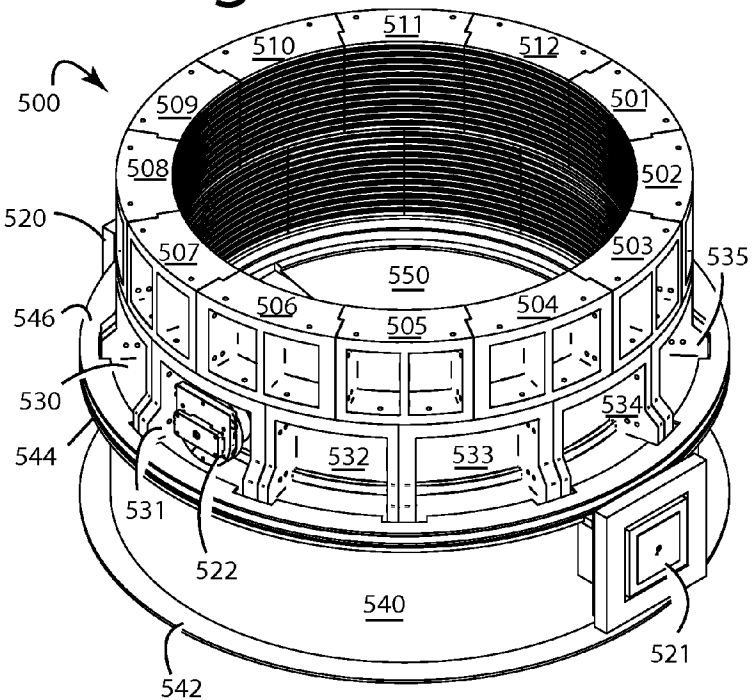
FIGS. 5A-5E are perspective, top, side, and cross-sectional view diagrams of a furnace that has a more traditional bottom section with the tap holes placed in a bottom shell and topped with the segmented coolers assembled into rings and two tiers. Cross-sectional diagrams 5D and 5E are taken through the metal/matte/alloy tap holes and lateral to them.
Figure 5B:
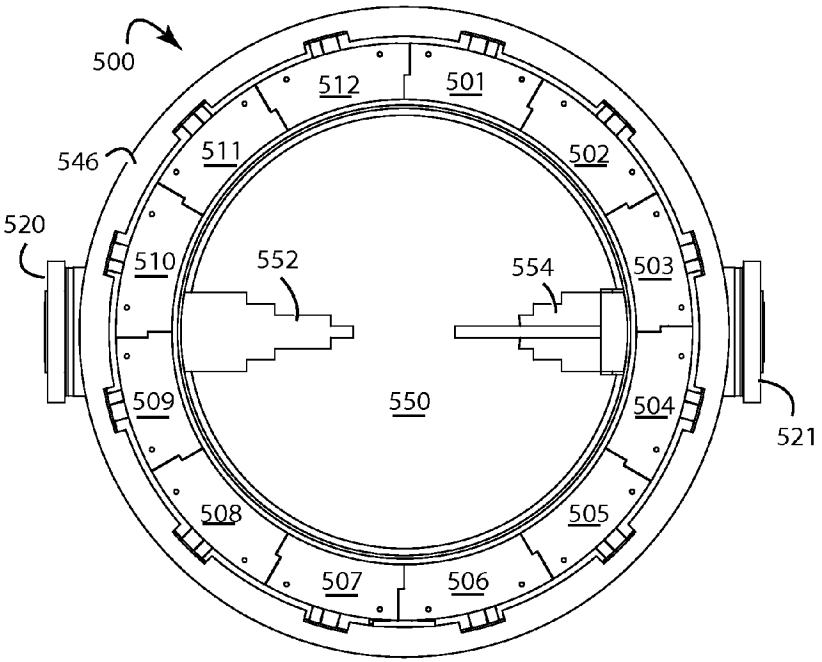
Figure 5C:
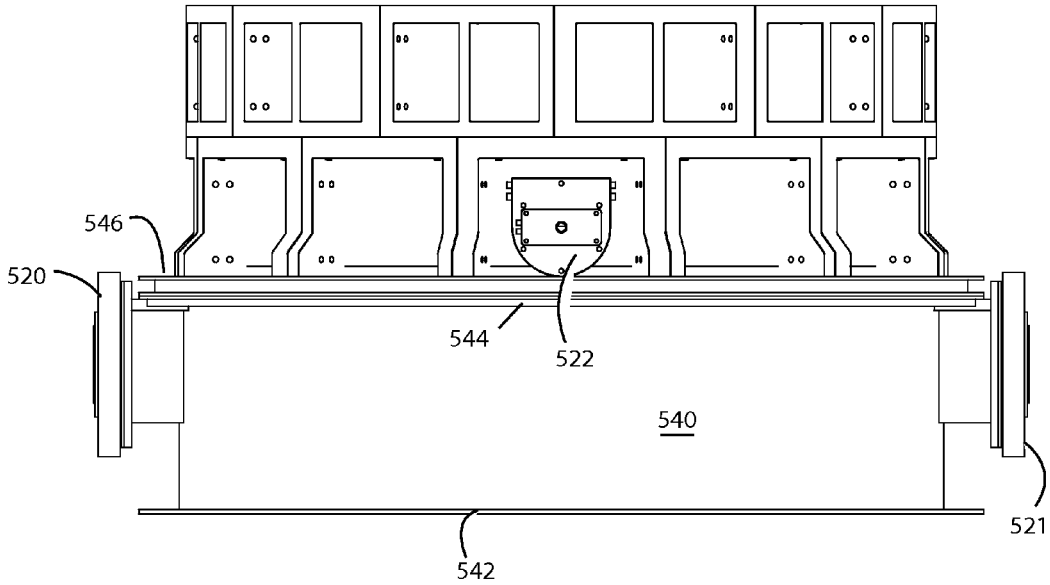
Figure 5F:
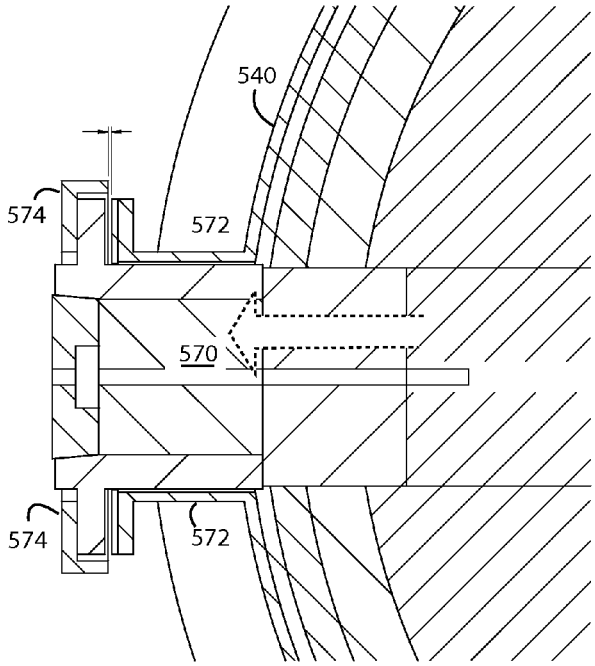

FIG. 5F is a cross sectional view diagram of one of the metal/matte/alloy tap holes in the furnace of FIGS. 5A-5E and is intended to show how the tap hole brick linings can slide inside a conduit, shell, sleeve, water-cooled block or similar structure to accommodate growth in the hearth brick; and FIGS. 6A-6D are perspective, top, front, and side view diagrams of a typical cooling block like those in the lower tier of wall-cooling blocks used in the hearth illustrated in FIGS. 5A-5E.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

Embodiments of the present invention do not rely on a full containment shell to provide the hoop strength and leverage necessary to compress the brick hearth in a furnace refractory. The coolers themselves are cast as segments of a ring that can be stacked in tiers, and then interconnected with springs and bolts through flanges on their outer perimeters to form an elastic hoop. The assembled coolers and adjustments provide the substantial inward compressive forces required to keep the gaps and joints closed in the brick hearth and walls that line the innards.

FIGS. 1A-1D represent an elastically interconnected cooler compressed hearth embodiment of the present invention, and is referred to herein by the general reference numeral 100. Hearth 100 comprises a bottom section 101 on which a first tier 102 and a second tier 103 of segmented coolers are assembled into rings and stacked. A base 104 is provided with a footer flange 106. A hold-down ring 108 is used to clamp the first tier 102 down to the bottom section 101.

Figure 1A:
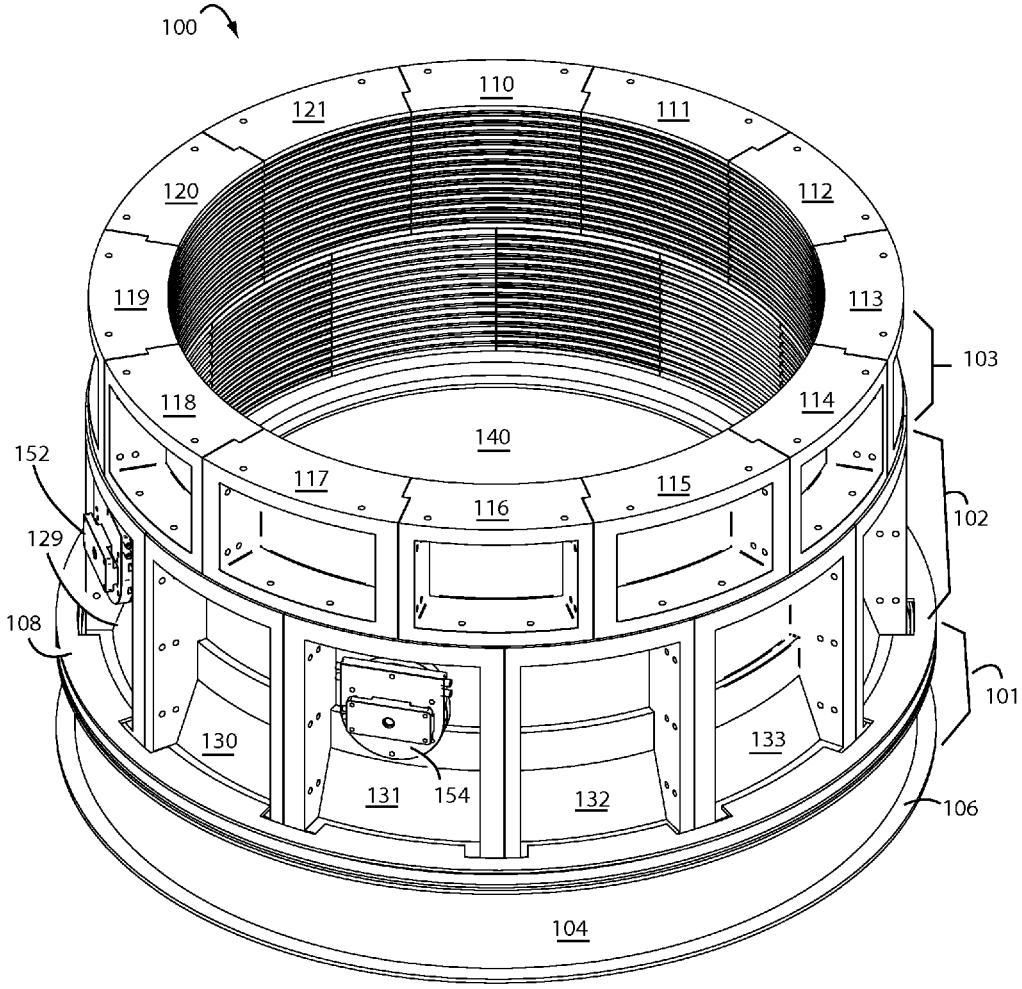
FIG. 1A is a perspective view diagram of an elastically interconnected cooler compressed hearth embodiment of the present invention.
Figure 1B:
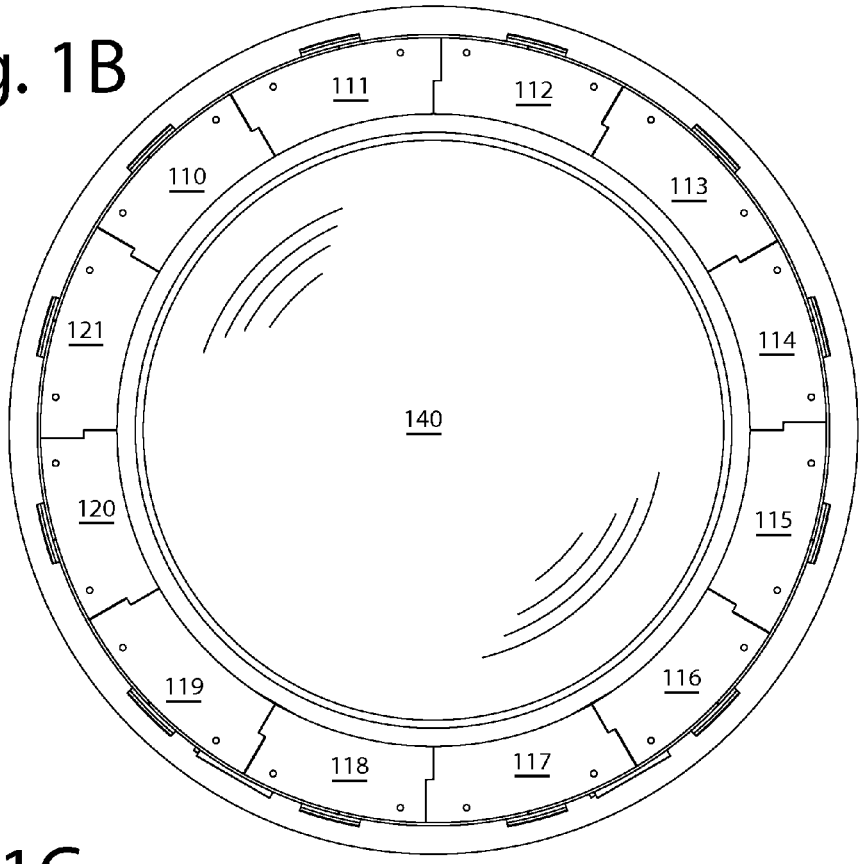
FIG. 1B is a top view diagram of the elastically interconnected cooler compressed hearth embodiment of FIG. 1A.
Figure 1C:
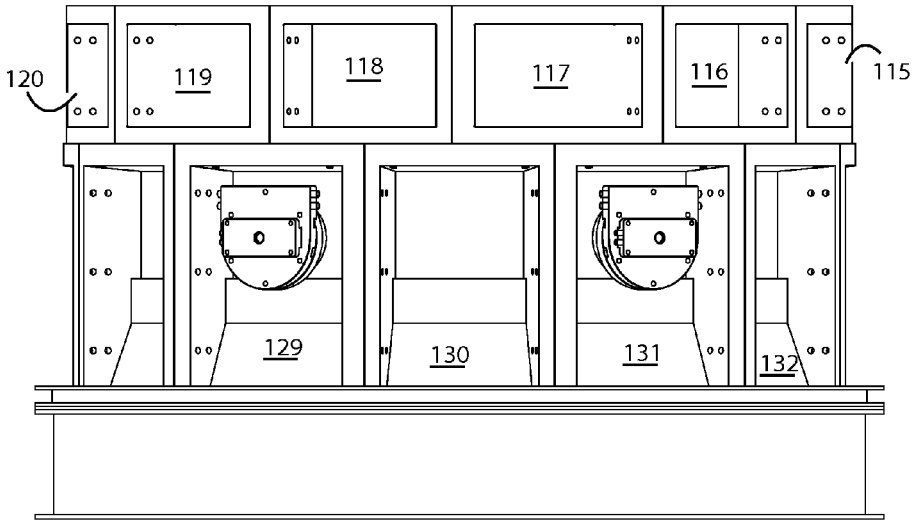
FIG. 1C is a side view diagram of the elastically interconnected cooler compressed hearth embodiment of FIG. 1A.
Figure 1D:
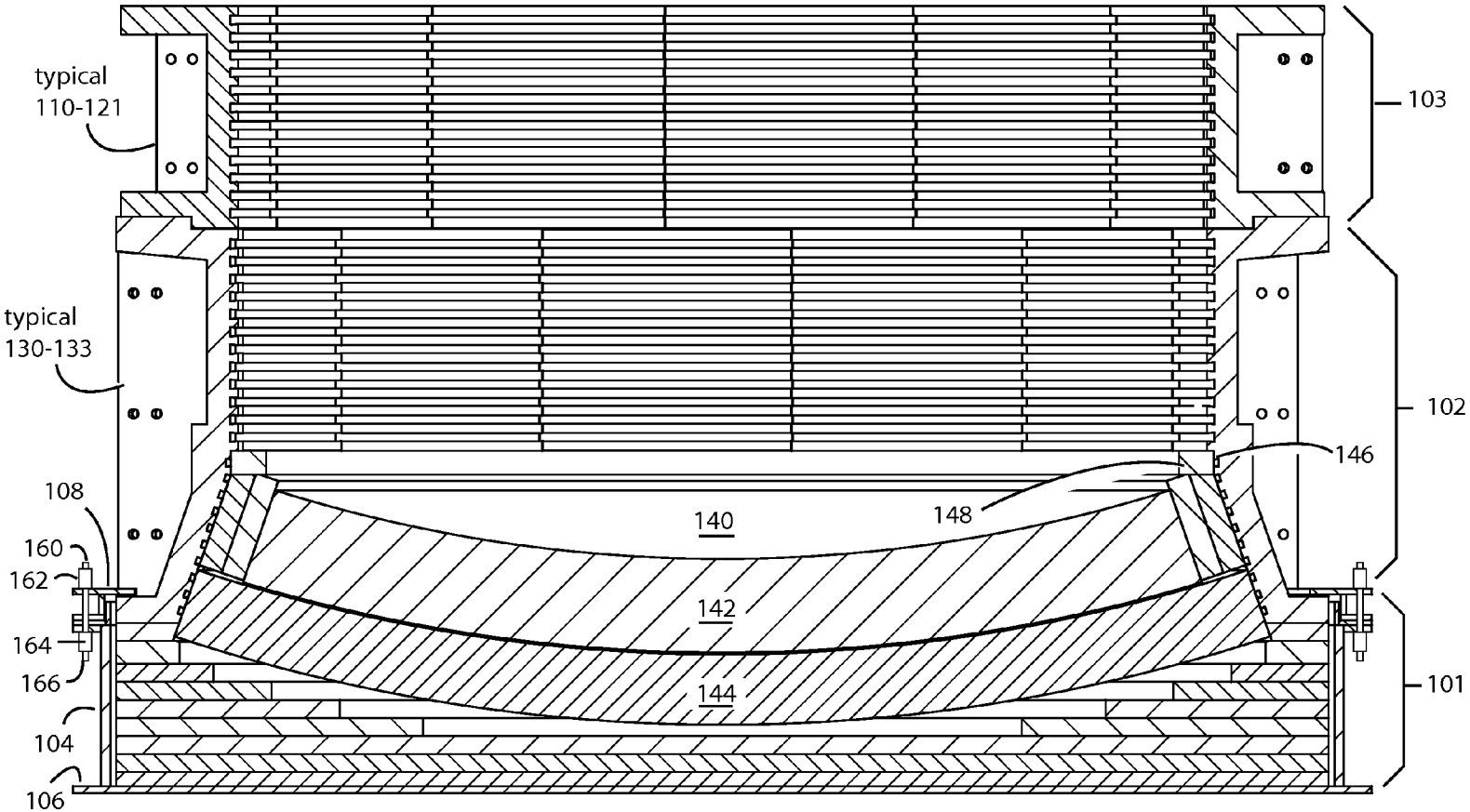
FIG. 1D is a cross sectional view diagram of the elastically interconnected cooler compressed hearth embodiment of FIG. 1A.

In FIG. 1A, every segmented cooler 110-121 is visible in the second tier 103, and several larger cooling segments in the first tier 102 are visible and identified as 129-133. These are typically constructed as cast and/or milled solid copper blocks with coolant passages.

FIGS. 1A-1D show that cooler segments 110-121 are provided with flanges so they can be elastically bolted together in a complete ring, and such rings can be further bolted to other rings above and below. For example, tier 103 to tier 102. The cooling segments in the first tier 102, e.g., 129-133, are similarly provided with flanges so that they too can be elastically bolted together into a complete ring and such ring can be bolted to other rings (103) or bottom sections (101) above and below. Tier 102 is shown as comprising single height coolers, but could be manufactured for one or more rings which may be required particularly at any tap holes.

A concave bottom floor 140 comprises a refractory or a bottom lined with a hearth brick working layer 142 (FIG. 1D) and a hearth refractory sub-layer 144 and kept in compression by the elastic ring of tier 102.

A notch 146 in the bottom inside edge of these cooling segments is used to nest a refractory or brick 148 which maintains a downward pressure on the top periphery of hearth brick working layer 142.

Tap holes 152 and 154 (best seen in FIG. 1C) are provided in two of the cooling segments in the first tier 102, e.g., 129 and 131.

If the weight of the walls are not sufficient to balance the upward forces at the rim of the hearth, and enough to seal the spaces between the wall and hearth, then a clamping system will need to be included. The hold-down ring 108 is spring-clamped to bottom section 101 and capture a flange on each of the cooling segments in the first tier 102, e.g., 129-133. For example, a bolt 160 is passed through a hold-down ring 108 into a flange on base 104. Two springs 162 and 164 allow some give as the refractory and hearth brick swell during the hearth's campaign life. The bolt and springs are retained and rendered adjustable by a nut 166. Those skilled in the design of hearths will be familiar with many other ways to implement the required compression and adjustability.

Figure 2:
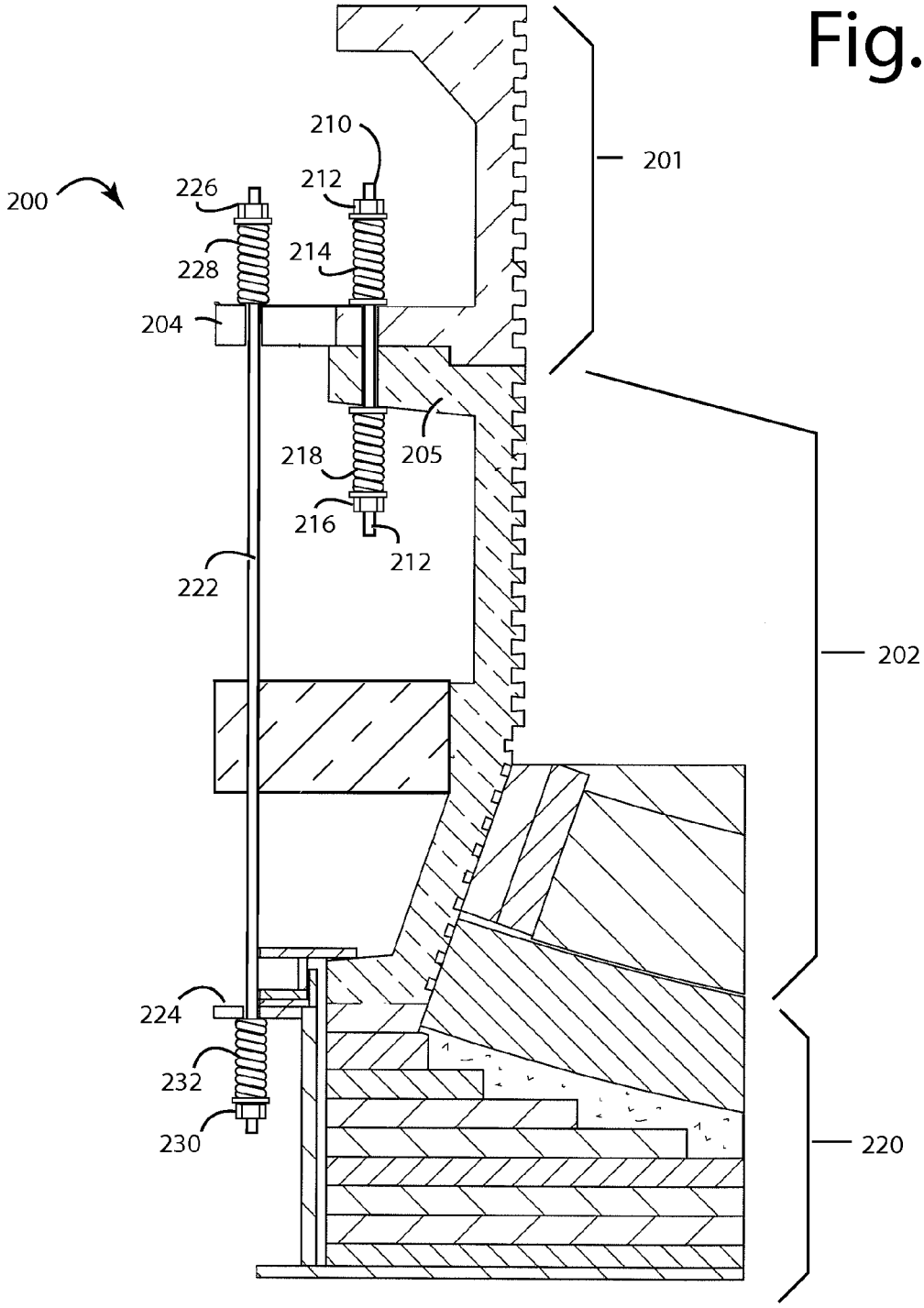
FIG. 2 is a straight cross section only of a furnace wall and part of the floor and base showing how the three sections of upper and lower cooler tiers can be elastically interconnected together and to a base using compression springs, threaded rods, and machine nuts.
Figure 3A:
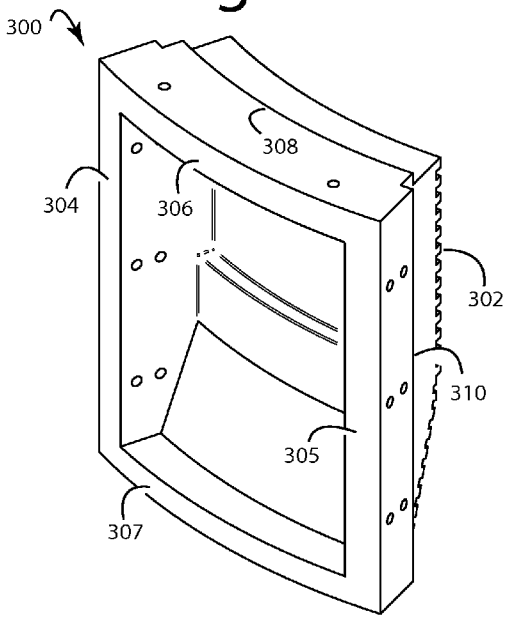
FIGS. 3A-3D are perspective, top, front, and side view diagrams of a typical cooling block like those in the first tier of the hearth illustrated in FIGS. 1A-1D.
Figure 3B:
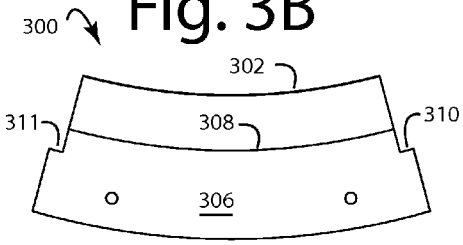
Figure 3C:
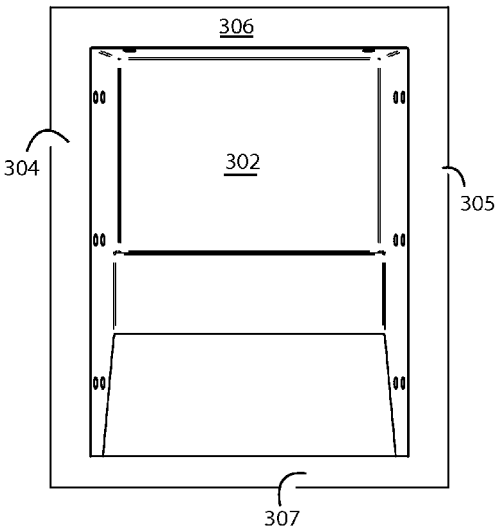
Figure 3D:
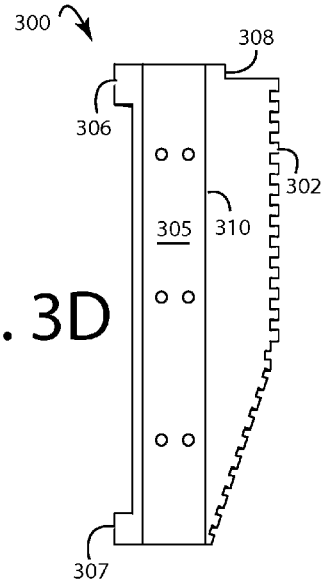

FIG. 2 illustrates alternative ways to hold down the tiers of a hearth in an embodiment of the present invention referred to here by the general reference numeral 200. A top tier 201 is clamped to a lower tier 202 using flanges 204 and 205. Since FIG. 2 shows only one cross section of the cylindrical walls and part of the base of a circular furnace, many such clamps, flanges, and fasteners would be used around the periphery. Typically, a threaded rod 210 and a nut 212 compress a spring 214 against flange 204. On the opposite, bottom side, the same threaded rod 210 and a nut 216 compress a spring 218 against flange 205. The result is top tier 201 can separate a little bit from lower tier 202 by compressing springs 214 and 218. This will occur naturally as the refractory and hearth brick swell over time.

Simpler arrangements can be used to interconnect the pieces together than is shown in FIG. 2. For example, a single bolt, nut, and spring can be used instead of the threaded rod, two springs and two nuts shown.

The shape of the wall cooler comes directly from the furnace geometry. The upper faces most often form a vertical cylinder that holds the feed and molten materials. A sloped face than bells out intersects with the hearth at the same angle as the outside, perimeter edges of the hearth brick. The bottom of the wall coolers are typically flat, e.g., to permit installation on the top of a brick or steel surface, or a lower water-cooled copper block.

The outside face of the wall coolers are relieved of as much as is possible by hollowing out to reduce weight and costs. The top, bottom, and side flanges, however, need to be kept quite robust to withstand the large forces involved in containing the furnace. These flanges are often tapered to simplify casting.

Similarly, the top and lower tiers 201 and 202 are fastened to a base 220 with a threaded rod 222 that passes through flange 204 and a base ring 224. A nut 226 is used to adjustably compress a spring down against flange 204, as is a nut 230 used to adjustably compress a spring 232 up against base ring 224. As before, the result is top and lower tiers 201 and 202 are able separate a little bit from base 220 and accommodate hearth growth by compressing springs 228 and 232.

FIGS. 3A-3D show a typical cooling block 300 like those in the first tier 102 in FIGS. 1A-1D. Such is usually constructed on copper with internal passages with which to flow a liquid coolant. The coolant circulation system is not important in this Disclosure and is not detailed further herein.

An inside, hot face hearth wall 302 interfaces with castable, refractory, brick, or slag, and the wall itself may be patterned, ribbed, or otherwise textured. Outside, four flanges 304-307 with several bolt holes each facilitate interconnections with other cooling blocks and hearth bases. The top and lateral outside edges of cooling block 300 are provided with lap joints, with horizontal lap joint 308 and vertical lap joint 310 being visible in FIGS. 3A and 3D. Vertical lap joint 311 can be seen in FIG. 3B. These lap joints allow limited movement and improved sealing between interconnected units.

It is critical that each of the cooler segments not be rigidly bolted together such that there is no flexibility or elasticity in the rings and tiers they form. In general, the hearth brick and/or refractory layered inside hearth 100 is kept in compression by providing bolt holes in the flanges so heavy compression type springs inserted under the bolt heads or nuts can maintain an even compression while also allowing some give during furnace thermal cycling. Other fastening and compression components can also be used. The use of compression springs drawn down by bolts and nuts allows the amount of compression and travel to be selectable and adjustable. The sizes and configurations of the springs, bolts, and nuts can be empirically selected and even refitted after furnace commissioning to optimize performance.

The interconnection of the cooling segments to one another to form a ring eliminates the need for an outer steel containment shell. In previous furnace designs, the outer containment shells provide the leverage and hoop strength needed by their compression systems to compress the hearth brick. Here, as seen in FIGS. 1A-1D, the assembled cooling segments form their own intrinsic wide-band hoop, and their interconnection devices allow for some expansion-contraction travel range and adjustability in the compressive strength.

In operation, adjustable spring assemblies are periodically set to a predetermined pressure value. The hearth brick working layer will inevitably grow in diameter as molecules of molten metal are absorbed into the refractory brick material and the infinitesimal spaces between them. Such growth necessitates routine readjustment of the adjustable spring assemblies, and so the conditions should be monitored.

The typical commercial furnace hearth size ranges from two to fifteen meters in diameter. The design configuration is used to impart initial compression of the hearth, which could result in an initial net shrinkage. The design must typically accommodate 20-150 mm of hearth expansion. On a percentage basis, this means up to a practical maximum of two percent of the hearth diameter.

The minimum compression forces on the hearth refractory brick should be sufficient to keep interfacial pressures between the bricks greater than the fluid pressures trying to come between them or the pressures to float the bricks. So an important design objective is to limit penetration of molten metal, matte or slag that gets into the joints. Too rapid a penetration can induce a quicker-than-normal rate of expansion of the hearth over the long term.

If too much molten metal penetrates under the bricks, individual bricks and sections of brick hearth can separate out and float to the top of the matte. Therefore, the hearth compression forces applied must be sufficient to maintain hearth stability, and overcome strong buoyancy pressures in spite of any molten metals getting beneath the hearth brick working layers.

Service life will be greatly increased at very modest cost when sufficient hearth compression pressures are applied. These help to maintain hearth stability by limiting melt penetration between the joints. The long-term hearth refractory rate-of-growth will not exceed that observed in conventional current hearth designs.

Corrosion can be an issue in those environments where corrosive gases are produced as part of the smelting process. Gases like $SO_2$ and $SO_3$ can readily form acids. Acid environments necessitate the use of stainless steel or nickel alloys to resist corrosion.

The parts that are exposed to high heat loads or molten materials will require cooling. If a component is to be cooled, it may be fabricated from a conductive alloy of copper or other metal, to minimize stresses and to reduce the potential for cracking. For example, the internal member used for distributing the compressive forces to the hearth may be cooled with air, water or other heat transfer fluid or gas. It may have internal cooling passages for conveying the heat transfer fluid or gas.

Figure 4:
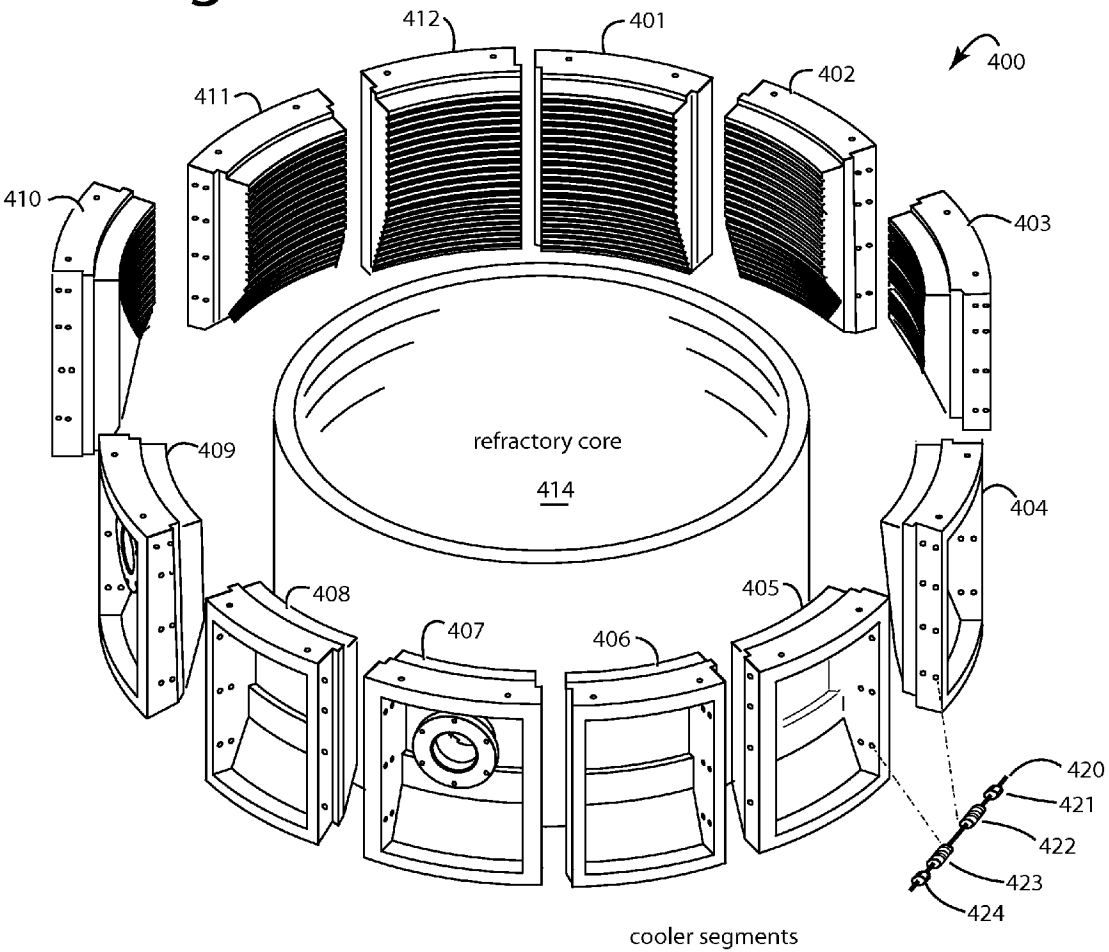
FIG. 4 is an exploded assembly perspective view of twelve cooler segments that are elastically bolted around and that compress a refractory core. Also shown is a typical threaded rod, springs, and machine nut assembly that can be used to join all the cooling blocks together at their flanges.

FIG. 4 represents an assembly 400 comprising twelve cooler segments 401-412 that are elastically bolted around and that compress a refractory core 414. Each cooler segment 401-412 is interconnected with its neighbors by included flanges and, e.g., eight spring-bolt assemblies on each side. Every such spring-bolt assembly comprises a threaded rod bolt 420 with a nut 421, a spring 422 on one side, and another spring 423 and nut 424 on the opposite side of the adjacent flange. Other configuration are also possible.

As the refractory core 414 swells during its campaign life due to metal absorption and joint penetration, the growth is taken up by springs 422 and 423. As it grows and the springs are compressed, small gaps will develop between the twelve cooler segments 401-412. However, the inward compressive pressure they cooperatively apply to the refractory core 414 will remain constant if nuts 421 and 424 on every spring-bolt assembly have been properly maintained.

In alternative designs where the coolers do not extend down as low as seen in FIGS. 1A-1D, the coolers can nevertheless be spring loaded together in a way that will keep the wall tight and eliminate the need for a shell plate. A different design is needed to accommodate hearth expansion at the lower tap hole level. As such, various embodiments of the present invention are useful for both wall and hearth compression.

On circular furnaces, the normal practice is to brick the hearth right up against the lower tap hole. As the hearth brick expands, it compresses the expansion material behind the skews. Without any crush material to accommodate and absorb normal expansion and swelling at the lower tap holes, the tap hole brick, shell, and coolers would be over-stressed by the strong outward pressures that can develop. Excess pressures can lead to shell distortion, cracking, and a displacement of the tap hole cooler away from the shell plate. Such can force open gaps and permit molten materials to leak through.

Local expansion movements at the lower tap holes must be accommodated without having to compress the entire hearth. The embodiments described here could be adopted immediately in many conventional furnaces. The upper wall coolers can be like those described in connection with FIGS. 1-4. The hot faces of the coolers may be patterned on their hot faces to help retain slag, refractory and/or accretions.

For example, FIGS. 5A-5E represent a furnace 500 that has a more traditional bottom section with the tap holes placed in a bottom shell and topped with the segmented coolers assembled into rings and two tiers. A top tier comprises wall-cooling blocks 501-512 assembled on top of a lower tier. Two matte/metal/alloy tap holes 520 and 521 are positioned in the base, and a slag tap hole 522 is positioned in a lower tier of larger coolers, e.g., 530-535. The number of tap holes included can vary. A shell plate 540 contains the base and is provided with a hearth bottom plate footer 542 and a top flange 544. If needed, a retaining ring 546 is used to clamp the lower tier of larger wall-cooling blocks to the top flange 544 and shell plate 540.

An interconnecting plate with slots bolted onto the outside faces of the wall-cooling blocks with shoulder bolts may be necessary to prevent adjacent wall-cooling blocks from getting askew of one another. For example, between the vertical flanges of coolers 532 and 533, and all others in the same tier.

No doubt other methods and devices could be adapted to prevent misalignments of the ship-lap joints between the coolers in order to control leakage.

A hearth floor 550 comprised of hearth brick 551 (FIG. 5E) has one or more tap hole through-cuts, e.g., 552 and 554, that assist in draining liquid melt out through matte/metal/alloy tap holes 520 and 521. The hearth brick 551 has a perimeter made of skew bricks 554 and these in turn are rimmed by expansion material 556. Expansion material may also be installed in the brick joints in various courses. The outer edges of hearth brick 551 tend to push outward and sometimes slightly upward over the campaign life.

In some embodiments of the present invention, a notch 560 is milled into the bottom inside corner of the hot faces of the lower wall-cooling blocks to retain and compress a brick ring 562 down on to an annular hearth floor retaining ring 564. The notch 560 assists in retaining the refractory and brick at a point in the furnace where the forces are very great and where high metal/matte/alloy levels could otherwise damage the cooling-wall blocks.

Figure 5D:
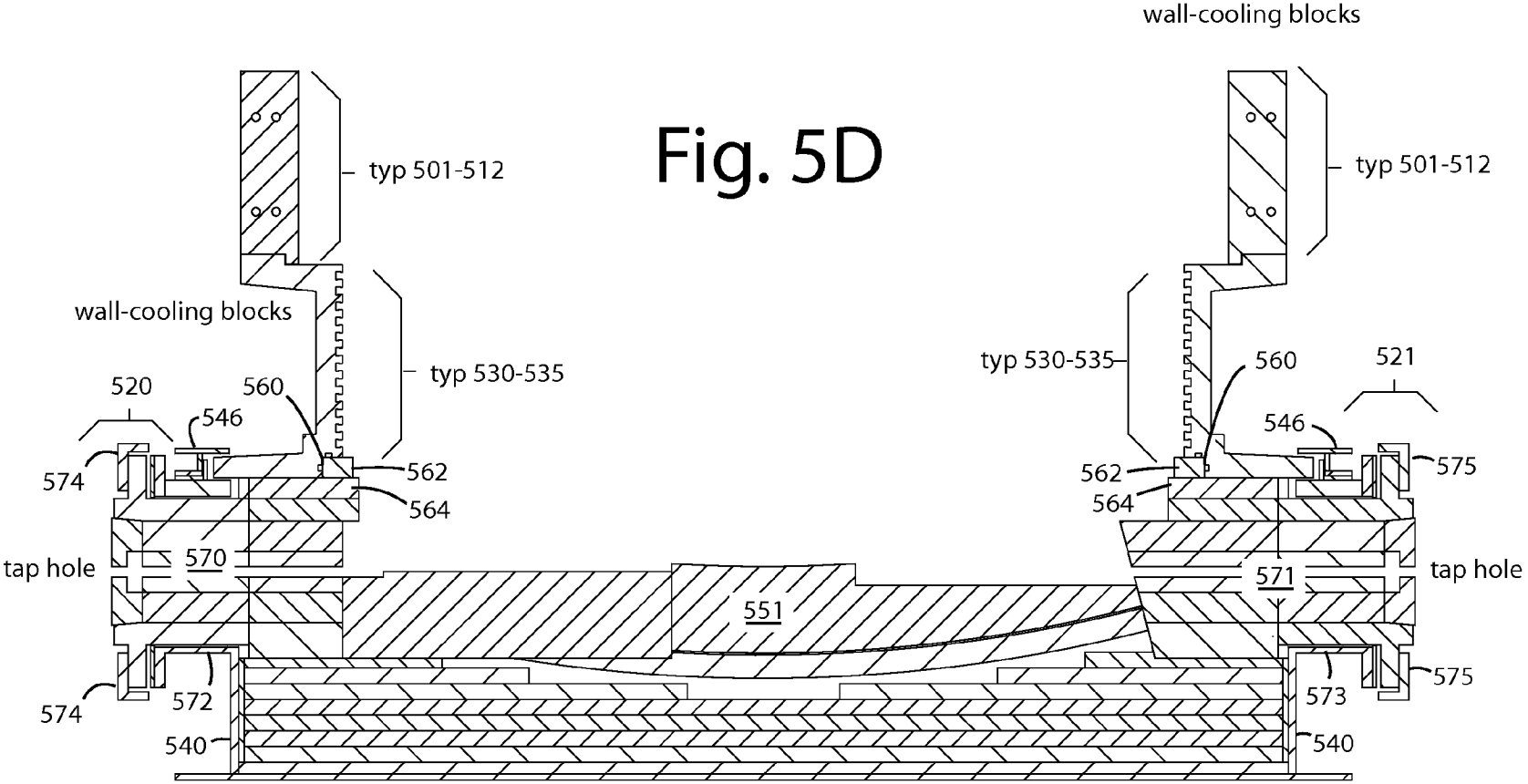

In FIG. 5D, the growing outward pressures of the hearth brick 551 press against the brick 570 and 571 lining the tap holes 520 and 521. Embodiments of the present invention accommodate these movements and pressures by allowing the tap hole brick linings 570 and 571 to slide within cylindrical conduits 572 and 573. Conduits 572 and 573 are capped by annular tap hole brick lining retaining rings 574 and 575. Such are fastened with spring assemblies that can accommodate the movements of the tap hole brick linings 570 and 571.

Alternatively, the brick in front of the tap hole can be replaced by a separate cooler. The cavities inside conduits 572 and 573 can be filled with refractory material, and can be sized to permit proper installation.

FIGS. 6A-6D show a typical cooling block 600 like those in the lower tier in FIGS. 5A-5E. Such are usually constructed of copper with internal passages with which to flow a liquid coolant. The coolant circulation system is not important in this Disclosure and is not detailed further herein.

Inside, the hot faces of hearth wall 602 can be horizontally ribbed, for example, to facilitate the attachment of refractory and hearth brick. Outside, four flanges 604-607 each facilitate interconnections with other cooling blocks and hearth bases. The top and side flanges are provided with bolt holes as well as lap joints. A horizontal lap joint 608 and vertical lap joint 610 are visible in FIGS. 6A and 6D. Vertical lap joint 611 can be seen in FIG. 6B. These lap joints allow limited movement and improved sealing between interconnected units. A notch 612 is equivalent to notch 560 in FIG. 5E.

Figure 5E:
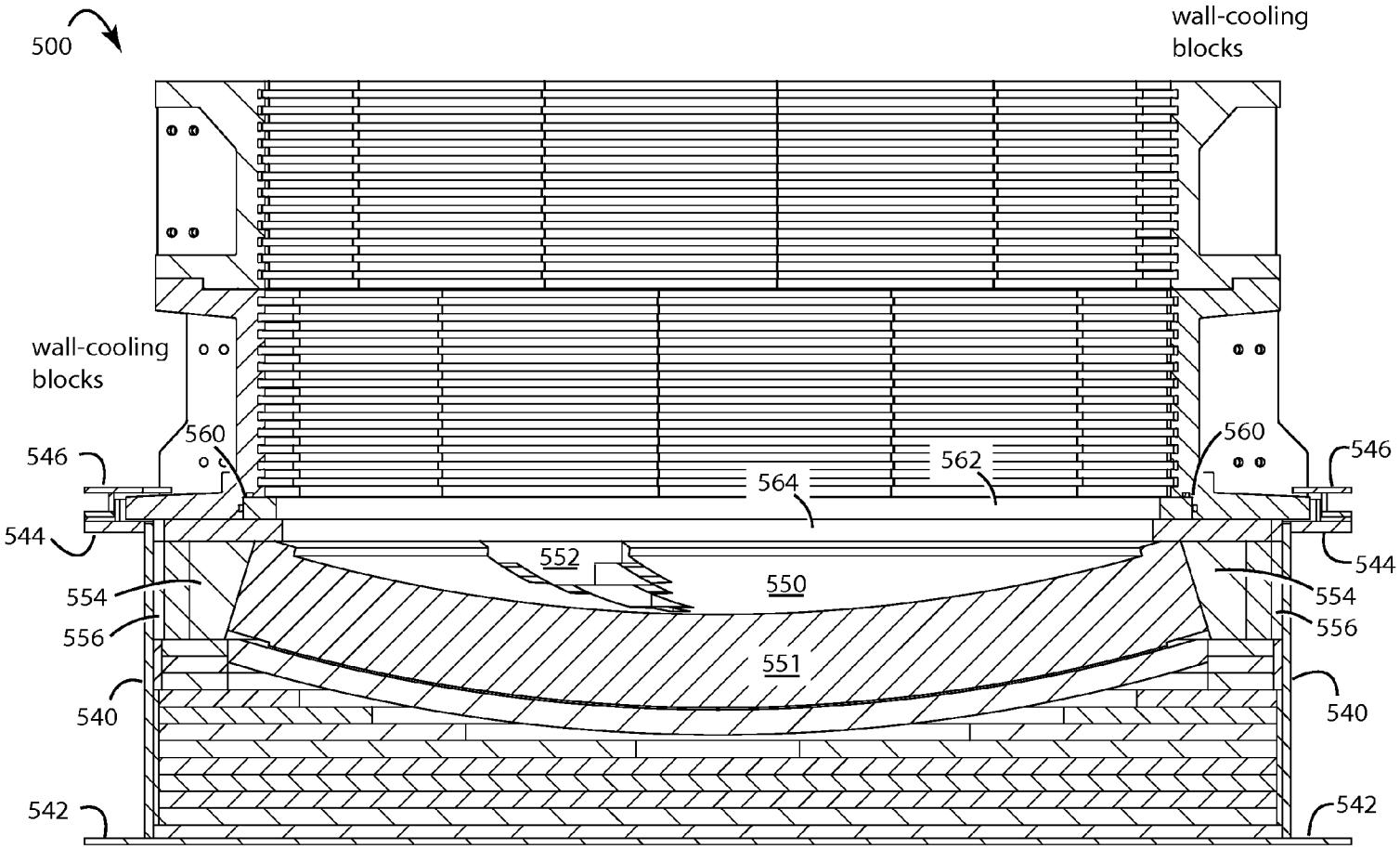
Figure 6A:
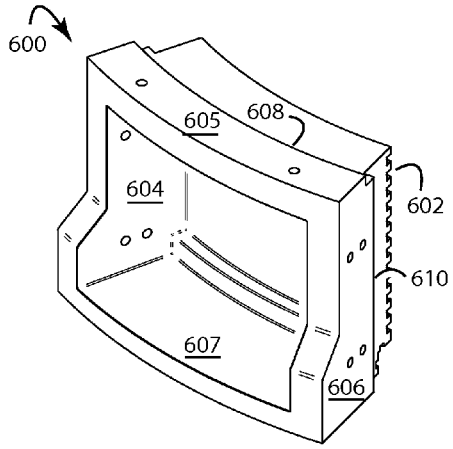
Figure 6B:
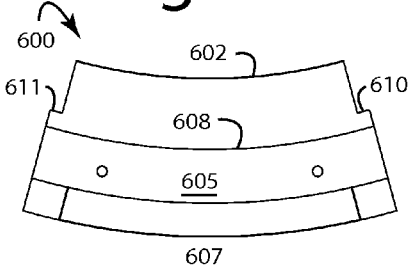
Figure 6C:
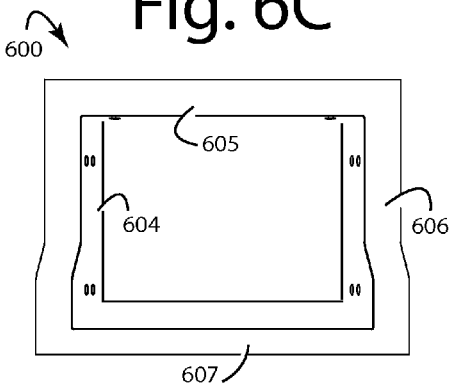
Figure 6D:
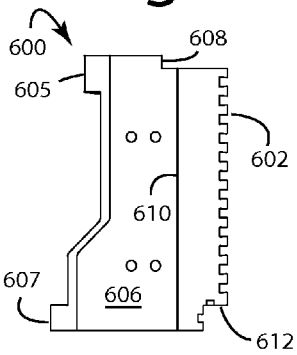

Embodiments of the present invention are used to best advantage as described herein for the lower walls and hearth, e.g., as in FIGS. 1A-1D, or for the lower walls for FIGS. 5A to 5D. FIGS. 5D, 5E and 5F include a lower shell plate to contain the hearth. In FIG. 5E, the wall coolers can be compressed to contain any wall brick, molten and feed materials, albeit less expansion need be accommodated.

The designs illustrated in FIGS. 5D and 5F principally accommodate hearth expansion and can be adapted for beneficial use in designs not using wall coolers.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed is:

1. An improved tap hole for a downwardly dished hearth brick in a compressed brick furnace hearth with a cylindrical base shell, the improvement comprising:

a hollow conduit radially attached to the outside of a furnace base shell and peripheral to a downwardly dished hearth brick, and concentric to a horizontally disposed tap hole;

a tap hole brick lining through which the tap hole is longitudinally and centrally disposed, and configured to fit inside the conduit and able to outwardly slide bit-by-bit in the hearth brick during the campaign life of the furnace to compensate for incremental growth;

wherein, excess pressures that would otherwise develop incrementally over time around the tap hole are relieved.

2. The improved tap hole of claim 1, further comprising:

an annular tap hole brick lining retaining ring positioned and configured to cap the conduit, and to be fastened with spring assemblies that will retain and compensate for movements of the tap hole brick lining and keep them tight over the campaign life of the furnace;

wherein, the tap hole brick lining is spring loaded to keep gaps between refractory bricks closed up tight.

3. The improved tap hole of claim 1, further comprising:

at least one tap hole includes a through-cut in the hearth brick and is configured to assist in draining out any liquid melt during operation.

4. The improved tap hole of claim 1, wherein the configuration is such that local expansion movements of brick at the tap hole are compensated for without depending on any mechanisms to compress the entire hearth.

5. The improved tap hole of claim 1, wherein the conduit comprises a shell, sleeve, water-cooled block, or equivalent structure for enclosing a tap hole.

6. The improved tap hole of claim 1, wherein a distal part of the brick of the tap hole further comprises a separate cooler, and any cavities inside the conduit are filled with refractory material.

7. An elastically interconnected cooler compressed hearth and walls, comprising:

one or more tiers of wall-cooling blocks shaped into arc segments and having flanges configured to be joined together to form complete sets of tiered rings;

a plurality of spring-bolt assemblies installed on said flanges and at the joints between individual wall-cooling blocks, and configured to close the spaces that develop between;

an outer perimeter of refractory and/or hearth brick within said tiered rings configured to be inwardly compressed by spring pressure toward the center to disallow any leaks from forming between separate bricks; and a tap hole comprising:

a hollow conduit radially attached to the outside of a furnace base shell and peripheral to a hearth brick, and concentric to a horizontally disposed tap hole; and a tap hole brick lining through which the tap hole is longitudinally and centrally disposed, and configured to fit inside the conduit and able to outwardly slide in the hearth brick bit-by-bit during the campaign life of the furnace to compensate for incremental growth;

wherein, excess pressures that would otherwise develop incrementally over time around the tap hole are relieved.

* * * * *